US008490659B2

(12) United States Patent
Laguzzi

(10) Patent No.: US 8,490,659 B2
(45) Date of Patent: Jul. 23, 2013

(54) APPARATUS FOR FILLING FLEXIBLE CONTAINERS WITH A FLUID, FOR EXAMPLE FOODSTUFFS, SUCH AS CREAM, YOGHURT, FRUIT JUICES AND PUREES, VEGETABLES AND SIMILAR

(75) Inventor: Fulvio Laguzzi, Asti (IT)

(73) Assignee: Flextech, S.r.l., Castellazzo Bormida, Alessandria (IT)

( * ) Notice: Subject to any disclaimer, the term of this patent is extended or adjusted under 35 U.S.C. 154(b) by 690 days.

(21) Appl. No.: 12/757,347

(22) Filed: Apr. 9, 2010

(65) Prior Publication Data

US 2010/0263763 A1 Oct. 21, 2010

(30) Foreign Application Priority Data

Apr. 15, 2009 (IT) ..... BS2009A0071

(51) Int. Cl.
*B65B 31/00* (2006.01)
*B67C 3/26* (2006.01)

(52) U.S. Cl.
CPC ..... *B67C 3/2614* (2013.01)
USPC ..... 141/57; 141/255; 141/258

(58) Field of Classification Search
USPC ..... 141/57, 250–284
See application file for complete search history.

(56) References Cited

U.S. PATENT DOCUMENTS

| | | | | | |
|---|---|---|---|---|---|
| 4,727,914 | A * | 3/1988 | Anderson et al. | ..... | 141/105 |
| 4,832,096 | A * | 5/1989 | Kohlbach | ..... | 141/114 |
| 4,893,659 | A * | 1/1990 | Loliger | ..... | 141/85 |
| 5,501,253 | A * | 3/1996 | Weiss | ..... | 141/40 |
| 5,727,606 | A * | 3/1998 | Weiss | ..... | 141/40 |
| 6,148,874 | A * | 11/2000 | Rutter et al. | ..... | 141/10 |
| 7,373,959 | B2 * | 5/2008 | Edwards et al. | ..... | 141/114 |

* cited by examiner

*Primary Examiner* — Timothy L Maust
(74) *Attorney, Agent, or Firm* — Kilyk & Bowersox, P.L.L.C.

(57) ABSTRACT

A filling apparatus of flexible containers with a dense fluid, such as cream, yoghurt, honey, fruit juice, medicines and similar comprises vacuum devices, gas supply devices, filling devices and a valve. The valve comprises a main body, an obturator, a needle and a needle operating mechanism able to move the needle in translation. The obturator duct is connected to the vacuum and gas supply devices, to remove any residues of fluid aspirated.

10 Claims, 1 Drawing Sheet

APPARATUS FOR FILLING FLEXIBLE CONTAINERS WITH A FLUID, FOR EXAMPLE FOODSTUFFS, SUCH AS CREAM, YOGHURT, FRUIT JUICES AND PUREES, VEGETABLES AND SIMILAR

The present application claims priority from Italian Patent Application No. BS2009A000071, filed Apr. 15, 2009, which is incorporated herein by reference.

BACKGROUND OF THE INVENTION

1. Field of the Invention

The present invention relates to an apparatus for filling flexible containers with a fluid, for example foodstuffs, such as cream, yoghurt, honey, fruit and vegetable juice and purées, medicines and similar.

2. Description of the Prior Art

It is well known how consumers today have an extremely varied choice of products available to them in fluid form, especially foodstuffs, contained in flexible containers, for example formed of two films of plastic materials facing each other.

Filling the containers with a fluid is an extremely important operation which must satisfy a number of requisites: the container must be filled with a preset and constant quantity of fluid, the filling procedure must be rapid (to save on production costs), fluid must not be wasted by pouring it outside the container, the outside of the container must not be soiled by the fluid, filling must be performed in an sterile environment and further requisites still.

In the sphere of container filling apparatus the filler valve which fills the container with fluid when it is engaged to it, is of crucial importance.

One embodiment of such a valve is illustrated in the document EP-A1-0894723.

Such valves perform three essential functions in succession: they enable creation of a vacuum in the flexible container, filling of the container with the fluid and, lastly, the supply of a quantity of inert gases, to act as an anti-oxidisation barrier.

SUMMARY OF THE INVENTION

The purpose of the present invention is to make a filling apparatus in which the valve has a simplified structure to reduce the risk of the accumulation of fluid in inaccessible areas and consequent formation of bacterial hotbeds.

Such purpose is achieved by a filling apparatus for flexible containers comprising:

vacuum devices able to generate a vacuum by suction;

gas supply devices, able to supply a pressurised gas;

filling devices, able to supply a dense fluid;

a valve comprising:

a) a main tubular body having a main inner compartment, connected to the filling device, and a main duct able to engage a straw of the container;

b) an obturator sliding in the main body between a forward position in which it closes off communication between the main duct and the main compartment and a retracted position, in which it allows communication, in which the obturator has an inner obturator duct and an obturator hole;

c) a needle sliding in the obturator duct between a retracted, closed position in which it closes the obturator hole and a forward open position, in which the hole is open;

d) means of operating the needle able to move the needle in translation;

in which the obturator duct is connected to the vacuum devices and the gas supply devices, to remove any residues of fluid aspirated.

DETAILED DESCRIPTION OF THE PREFERRED EMBODIMENTS

Figure 2:
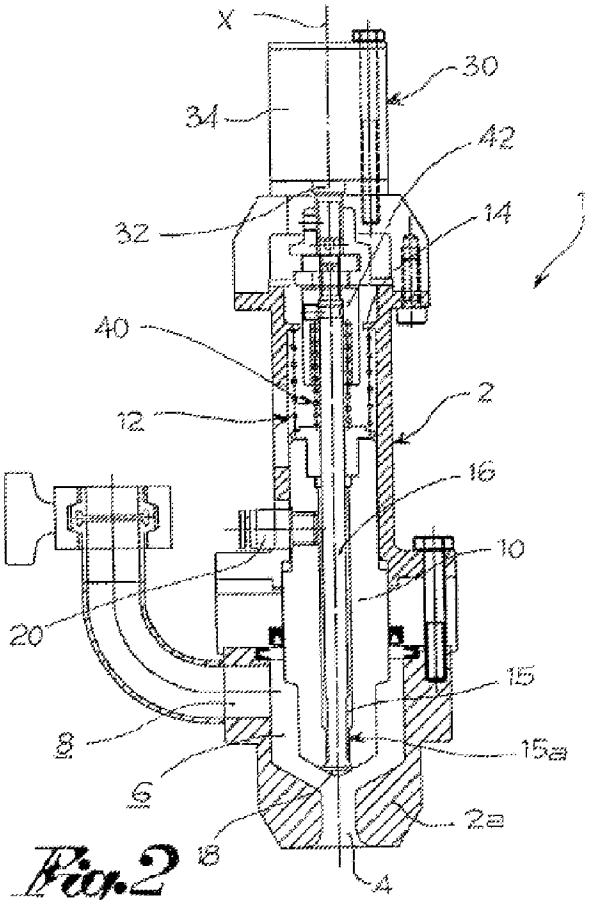
FIG. 2 shows the valve in FIG. 1, in a filling configuration.

An apparatus for filling flexible containers, such as a container C comprising a straw T, and two walls W made of flexible film, joined to each other along the edge, between which the straw T is inserted, comprises a filling valve 1.

The valve 1 comprises a main tubular body 2, which extends mainly along a main axis X.

The main body 2 comprises an end wall 2*a*, into which a main duct 4 opens, which comes out in a main compartment 6 inside the body 2.

The main compartment 6 is placed in communication with fluid supply devices of the apparatus (not shown) by means of a fluid supply duct 8, suitable for supplying the fluid to fill the container with.

During normal functioning, the straw T of the container C is inserted in the main duct 4 of the end wall 2*a*.

The valve 1 comprises, in addition, an obturator 10 sliding in the main body 2 and having a tubular shape elongated along the main axis X.

According to a preferred embodiment, the obturator 10 is made from polymer material.

The end of the obturator facing towards the end wall 2*a* is tapered, as is the end wall 2*a* at the entrance of the main duct 4, so that when the obturator is in contact with the end wall, it closes off communication between the main compartment 6 and the main duct 4.

The obturator 10 consequently slides between a forward position, in which it closes off communication between the main compartment 6 and the main duct 4, and a retracted position, in which it allows communication.

The valve 1 preferably comprises in addition, obturator security devices able to constantly act on the obturator to press it from the retracted position to the forward position when there is no air.

For example, the obturator security devices comprise a spring 12.

Preferably, the spring 12 acts on the obturator 10 at the end opposite that facing the main duct 4; at the other end to that engaged with the obturator, the spring 12 abuts, for example, against an annular boss 14 which projects inwards from the main body 2.

The obturator 10 is traversed internally, along the main axis X, by an obturator duct 15 which terminates, on the side facing the main duct 4, in an obturator hole 15*a*.

The valve 1 comprises, in addition, a needle 16, positioned along the main axis X and sliding inside the obturator 10.

The needle 16 projects from the obturator 10, through the obturator hole 15*a*, and has an enlarged head 18 shaped so as to close the obturator hole 15*a* when abutting with the obturator.

In particular, the head 18 is enlarged so as to be a bigger than the aperture of the straw T, so as not to fall inside the container. At the same time, the head 18 is smaller than the main duct 4, so as to form a passage when inserted in it.

The needle 16 has, at least in the section inside the obturator 10, a smaller diameter than the obturator duct 15, so that the cavity can be traversed by a gas.

In particular, the valve 1 comprises an intake 20, joined to the obturator 10, which places the obturator duct 15 in communication with vacuum device 7 of the apparatus, able to generate negative pressure so as to aspirate the air contained in the container, and with gas supply device 9, able to supply a pressurised gas.

The needle 16 therefore slides in the obturator 10 between a retracted, closed position, in which the head 18 closes the obturator hole 15*a*, so that the obturator duct 15 does not communicate with the main compartment 6, and a forward, open position.

The valve 1 comprises, in addition, means of operating the needle 16 able to move it from the open position to the closed position.

Preferably, the operating mechanism comprises a cylinder-piston group 30; the piston 32 of the cylinder-piston group is joined to the needle 16, at the end opposite the enlarged head 18, while the cylinder 34 of the cylinder-piston group is attached to the main body 2, on the side opposite that of the end wall 2*a*.

The valve 1 comprises, in addition, needle return mechanisms able to constantly act on the needle 16 so as to bring the enlarged head 18 in abutment against the obturator 10, in other words towards the closed position of the needle.

Preferably, the needle return mechanisms comprise a spring 40 and a cup 42 attached to the needle; the spring 40 is compressed between the obturator 10 and the cup 42.

During normal functioning of the machine, the container C is engaged with the valve 1, and in particular the straw T is inserted in the main duct 4.

Figure 1:
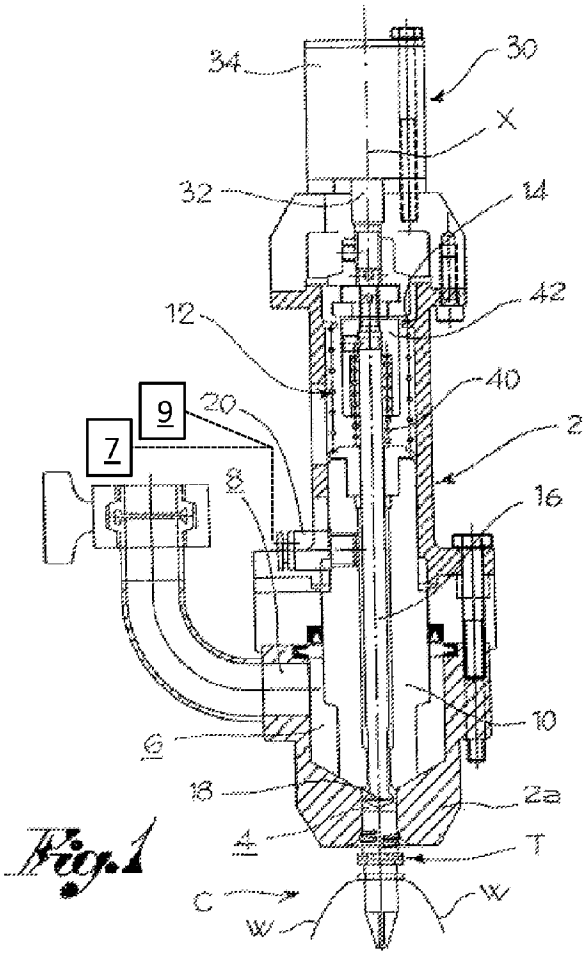
FIG. 1 shows a section of a valve of a filling apparatus according to the present invention, in a vacuum and gas supply configuration.

In a first phase of the procedure, called the vacuum phase, the obturator is in the forward position and the needle is in the open, forward position (vacuum configuration, FIG. 1).

As a result, the fluid supply duct 8 and the main compartment 6 are not in communication with the main duct 4, while the obturator duct 15 is in communication with the main duct 4.

To reach the vacuum configuration, the needle operating mechanism is activated in the sense that the piston 32 is brought into the forward position, overcoming the resistance of the needle return mechanism, and maintaining such position for the entire vacuum phase: the needle is therefore in the open, forward position. The obturator security devices rather push the obturator into the forward position, until it abuts against the end wall 2*a*. The needle return mechanisms also act on the obturator, pushing it into the forward position.

The vacuum device 7 is activated so as to create a negative pressure which aspirates the air from the container C, through the intake 20, the obturator duct 15, the open obturator hole 15*a* and the main duct 4.

In a subsequent phase of the procedure, called the filling phase, the obturator is in the retracted position and the needle is in the closed, retracted position (filling configuration, FIG. 2).

As a result, the fluid supply duct 8 and the main compartment 6 are in communication with the main duct 4, while the obturator duct 15 is not in communication with the main compartment 6 or with the main duct 4.

To reach the filling configuration, the needle operating mechanism is activated in the sense that the piston 32 is brought into the retracted position: the needle is therefore in the closed, retracted position and the head 18 has also dragged the obturator to the retracted position, raising it from the end wall 2*a* and overcoming the resistance of the obturator security devices.

The fluid supply means are activated so as to supply the container with the fluid, through the fluid supply duct 8, the main compartment 6 and the main duct 4.

The fluid contained in the main compartment 6 does not have access to the obturator duct 15, since it is closed off by the enlarged head.

When filling has been completed, in a further subsequent phase of the procedure called the gas supply phase, the obturator is in the forward position and the needle is in the forward, open position (gas supply configuration, FIG. 1).

As a result, the fluid supply duct 8 and the main compartment 6 are not in communication with the main duct 4, while the obturator duct 15 is in communication with the main duct 4.

To reach the gas supply configuration, the needle operating mechanism is activated in the sense that the piston 32 is brought into the forward position, overcoming the resistance of the needle return mechanisms, and maintaining such position for the entire gas supply phase: the needle is therefore in the open, forward position. The obturator security devices rather press the obturator into the forward position, until it abuts with the end wall 2*a*.

The gas supply device 9 is activated so as to supply pressurised gas, usually inert gases such as nitrogen, to the container C, through the intake 20, the obturator duct 15, the open obturator hole 15*a* and the main duct 4.

Innovatively, the filling apparatus described above makes it possible to use a valve with a simplified structure, which limits the accumulation of fluid in inaccessible areas and thereby the formation of bacterial hotbeds.

Advantageously, the path of the pressurised gas towards the container coincides with the aspiration path, so that any residues of fluid along the path are removed by the flow of gas.

Advantageously, in addition, the container remains engaged in the same position during the vacuum, filling and gas supply phases; as a result the apparatus according to the invention avoids the use of devices to modify the position of the container.

According to a further advantageous aspect, the simplified structure makes it possible to reduce the number of seals and gaskets, increasing the reliability of the valve and making for longer servicing intervals.

In addition, the use of the polymer material for the obturator makes it possible to avoid the use of sealing bands.

What is claimed is:

1. An apparatus for filling flexible containers with a dense fluid such as cream, yoghurt, honey, fruit juice, and medicines, comprising:

a vacuum device able to generate a vacuum by suction;

a gas supply device, able to supply a pressurised gas;

a filling device, able to supply a dense fluid;

a valve comprising:

a) a main tubular body having a main inner compartment, connected to the filling device, and a main duct able to engage a straw of the container;

b) an obturator sliding in the main body between a forward position in which it closes off communication between the main duct and the main compartment and a retracted position, in which it allows communication, in which the obturator has an inner obturator duct and an obturator hole;

c) a needle slidable in the obturator duct between a retracted, closed position in which it closes the obturator hole and a forward open position, in which the obturator hole is open;

d) needle operating means able to move the needle in translation;

wherein the obturator duct is connected to the vacuum device and the gas supply device, to remove any residues of fluid aspirate;

and wherein the valve comprises an obturator security device able to constantly bias the obturator from the retracted position to the forward position, and a needle return mechanism able to constantly bias the needle from the forward, open position to the retracted, closed position.

2. Apparatus according to claim 1, wherein the needle operating means comprises a double-acting cylinder piston group.

3. Apparatus according to claim 1, wherein the obturator security device comprises an obturator spring.

4. Apparatus according to claim 3, wherein the spring is engaged with the obturator at the end opposite that facing the main duct and at the other end abuts against an annular boss which projects inwards from the main body.

5. Apparatus according to claim 1, wherein the needle projects from the obturator through the obturator hole and has an enlarged head shaped so as to close the obturator hole when abutting with the obturator and smaller than the main duct so as to form a passage when inserted in it.

6. Apparatus according to claim 1, wherein the needle return mechanism comprises a needle spring.

7. Apparatus according to claim 6, wherein the needle return mechanism comprises a cup attached to the needle and wherein the needle spring can be compressed between the obturator and the cup.

8. Apparatus according to claim 1, wherein the obturator is made in polymeric material.

9. Apparatus according to claim 1, wherein the valve is free of sealing bands between the obturator and the needle or between the obturator and the main body.

10. An apparatus for filling flexible containers with a dense fluid such as cream, yoghurt, honey, fruit juice, medicines and similar, comprising:

a vacuum device able to generate a vacuum by suction;

a gas supply device able to supply a pressurised gas;

a filling device able to supply a dense fluid;

a valve comprising:

a) a main tubular body having a main inner compartment, connected to the filling device, and a main duct able to engage a straw of the container;

b) an obturator slidable in the main body between a forward position in which it closes off communication between the main duct and the main compartment and a retracted position, in which it allows communication, in which the obturator has an inner obturator duct and an obturator hole;

c) a needle slidable in the obturator duct between a retracted, closed position in which it closes the obturator hole and a forward open position, in which the obturator hole is open;

wherein the obturator duct is connected to the vacuum devices and the gas supply device, to remove any residues of fluid aspirated;

and wherein the obturator is made in polymeric material and the valve is free of sealing bands between the obturator and the needle or between the obturator and the main body.

* * * * *